US006419004B1

(12) United States Patent
Jolivet et al.

(10) Patent No.: US 6,419,004 B1
(45) Date of Patent: Jul. 16, 2002

(54) MOLD OR WIDE CROSS SECTION FOR THE HOT-TOP VERTICAL CONTINUOUS CASTING OF METALS

(75) Inventors: Jean-Marc Jolivet, Rurange-les-Thionville; Roger Kraemer, Maizieres-les-Metz; Hervé Morand, Metz; Cosimo Salaris, Montigny-les-Metz; Jacques Barbe, Saint Etienne, all of (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/705,891

(22) Filed: Nov. 6, 2000

(30) Foreign Application Priority Data

Nov. 5, 1999 (FR) ..... 99 14030

(51) Int. Cl.[7] ..... B22D 11/49; B22D 11/00

(52) U.S. Cl. ..... 164/418; 164/444; 164/487; 249/106; 249/197

(58) Field of Search ..... 164/444, 487, 164/418, 459; 249/106, 197

(56) References Cited

FOREIGN PATENT DOCUMENTS

| | | |
|---|---|---|
| EP | 0 620 062 | 10/1994 |
| FR | 2 667 002 | 3/1992 |
| FR | 2 747 061 | 10/1997 |
| FR | 2 747 062 | 10/1997 |
| FR | 2 764 533 | 12/1998 |

*Primary Examiner*—Kuang Y. Lin
(74) *Attorney, Agent, or Firm*—Sughrue Mion, PLLC

(57) ABSTRACT

A mold for hot-top vertical continuous casting of metals includes a feed head (8) made of a thermally insulating refractory material which surmounts a cooled copper crystallizer (9) and is internally aligned with a cooled copper element (14) of the cooled copper crystallizer (9) in order to define a calibrating passage for the cast metal. The copper element (14) is formed by an assembly of plates, some of which, termed "large walls", are each held against a reinforcing backplate (16) to which it is rigidly fastened by a clamp (22), the shape of which is elongate in the width direction of the large wall and which goes over the top of the large wall and its associated backplate.

6 Claims, 2 Drawing Sheets

MOLD OR WIDE CROSS SECTION FOR THE HOT-TOP VERTICAL CONTINUOUS CASTING OF METALS

FIELD OF THE INVENTION

The invention relates to the hot-top continuous casting of metals, especially steel. It relates more particularly to the hot-top casting of semifinished metals of elongate shape, such as slabs, thin slabs, etc., which are consequently cast in molds called molds of "wide cross section".

It will be recalled that a mold of wide cross section is above all a bottomless metal tube which is disposed vertically and in which the cast steel solidifies on contact with the inner wall cooled vigorously by an intense circulation of water. This tubular element, conventionally made of copper, or more generally made of a copper alloy, has an ordinary height of the order of one meter. However, it differs from other types of continuous casting mold mainly by the fact that it is not monolithic but consists of four plates joined together at right angles: a pair of large plates, facing each other and intended to form the large faces of the cast slab, which is often much more than one meter in width, and a pair of small side plates mounted in line with the ends of the large plates in order to provide a seal with respect to the cast molten metal. Usually, for the sake of simplifying the vocabulary, these plates are called large or small "walls" or, by analogy with the cast slab, large or small "faces".

Moreover, in its current state of development, the so-called "hot-top" continuous casting of metals may be regarded, technically speaking, as an evolution of the conventional continuous casting process, which evolution shifts along the casting height at the level where the solidification of the metal in the mold occurs from the other level, located above it, where the free surface (or "meniscus") of the liquid metal in contact with the wall of the mold lies.

As is known, the first solidification takes place by a very sensitive physical mechanism and, at the same time, this represents an essential factor in the quality of the product obtained. By virtue of the heightwise separation of these two levels, which in conventional continuous casting are coincident or almost coincident, this solidification takes place in a hydrodynamically calm location, remote from the always disturbed zone of the meniscus region. Specifically, this separation of the two levels is obtained by surmounting the cooled copper body of the mold with an attached feed head, which is not necessarily cooled. The feed head is typically made of a refractory material having high thermally insulating properties and is internally well aligned with the mold to keep, throughout the duration of the casting operation, the meniscus of cast steel poured from a tundish placed just above it.

Hot-top continuous casting of this type, although known for a long time according to these principles, as described for example in EP-A-0620062, has at the present time, to the Applicant's knowledge, still not achieved industrial realization. The studies carried out more recently by the Applicant on the subject (see for example FR-A-2747061 and FR-A-2747062) have, however, shown the great advantage of providing, in the bottom part of the insulating refractory feed head, an insert made of a dense refractory material which is mechanically much stronger than the usual insulating refractories. This inserted piece must in fact simultaneously be a good heat insulator, in order to keep, like the feed head, the molten steel that it contains in the liquid state, and have good mechanical strength properties in order to retain for as long as possible the geometry of the upper edge of the copper wall on which it rests, specifically at the point where the solidification of the cast metal is initiated. It is known that a material such as SiAlON (R) satisfies such requirements quite well. However, this type of material is expensive, particularly when it has to be shaped into a ring matching the inner perimeter of the mold. Further, the cost may even become prohibitive for long inserts, as is necessarily the case for molds of wide cross section.

Moreover, it is exceedingly important for the success of the casting operation to maintain strict alignment of the SiAlON insert with the large faces of the mold which are placed beneath it within very narrow tolerance margins, of the order of 1/10th of a mm. Such a requirement is all the harder to meet since the inevitable hot differential expansion phenomena of the elements present in contact with the molten metal are a major cause of misalignment. In addition, it should be noted that such phenomena are of greater consequence the larger the size of the mold, something which is particularly the case, here again, when casting steel slabs (the width conventionally being able to reach or even exceed 2 m).

Now, this alignment requirement specific to hot-top continuous casting is not well met by the current technology of molds of wide cross section. The current mold technology relies schematically on the principle of the stiffening backplate. Each large copper plate bears on a stiffening plate which is matched to it, being fastened thereto by assembly with the aid of transverse ties anchored in the copper plate and distributed over the height and over the width of the plate with inter-tie spacings of some twenty cm approximately. The robustness of such an assembly cannot be disputed. However, during casting, in other words when "hot", it results in a wavy deformation of the copper plate between each tie. Admittedly, this deformation, of a few tenths of a mm at most, is of no real consequence in conventional continuous casting, but it is totally unacceptable in hot-top continuous casting because of the misalignment that it causes between the copper plate and the refractory feed head in their mating plane, at precisely the point where the first shell of solidified cast metal is formed.

SUMMARY OF THE INVENTION

The object of the present invention is to provide a simple, reliable and economic solution to the aforementioned difficulties encountered with the hot-top continuous casting of products of wide cross section.

For this purpose, the subject of the invention is a mold of wide cross section for the hot-top vertical continuous casting of metals, particularly steel, comprising a tubular body formed by an assembly of copper, or copper alloy, plates cooled by the circulation of a coolant, this cooled metal tubular body being surmounted by a feed head made of a thermally insulating refractory material, internally aligned with it and having, among the plates of which it is composed, large plates each fastened to stiffening backplates with the aid of distributed transverse ties, wherein the upper part of each of said large plates has a shoulder set back with respect to the plane of the large plate in order to be able to engage with the jaw of a clamp of elongate shape, which clamp thus fastens the upper part of the large plate against the associated backplate, by going over the top of the latter and providing a continuous grip distributed over the width of the large plate, the base of the refractory feed head resting against that part of the shoulder left clear by the jaw of the clamp, the other jaw of the clamp being provided with means for adjusting the clamping by bearing against the associated backplate.

As will have doubtless been understood, the ties of the upper part of the mold are replaced by a clamp whose jaw, and therefore the bearing surface, may also be extended as required along the upper edge of the large plates, or even continuously, so as to completely counteract the vague tendency of the upper edge of the large copper plates to deform, this point in the mold being very sensitive in the success of hot-top casting, as explained above. This clamp goes over the top of each large plate and its associated backplate. A step, set back from the upper edge of the large plate, is thus designed to allow the jaw of the clamp to be positioned in the shoulder thus provided at the top of the mold in order to bear on the heel of the copper plate and consequently clamp it rigidly against the base plate on which the other jaw of the clamp acts. This modification of the shape of the upper part of the large plates according to the invention is reminiscent of the shape at the "head of the femur" except that, however, the offset head is intended, not for pivoting in an accommodating cupola, but to serve for a locking clamp to be engaged against the backplate.

Since the step is intentionally larger in size than the jaw of the clamp which it houses, the space thus left free on the shoulder in front of the jaw constitutes an alignment housing for easily positioning a refractory feed head.

It is consequently possible, much more easily than hitherto, to make the insert, provided at the base of the feed head, from a hard "SiAlON" refractory. Thus, this construction, by the assembly of juxtaposed sections (FR-A-2764533) whose alignment with respect to one another is the guarantee of the indispensable rectitude of the entire assembly, is carried out, according to a secondary subject of the invention, from sections of refractory material, each one of which is gripped hot in a metal shell which provides them with the desired mechanical strength and which are mounted in a strip on a rigid guide rod until the desired length is obtained (equal at most to the width of the large plate) and at the ends of which rod resilient clamping means are provided so as to keep the sections clamped together.

BRIEF DESCRIPTION OF THE DRAWINGS

The invention will in any case be clearly understood, and further aspects and advantages will become more clearly apparent, from the description which follows, given as an illustrative example and with reference to the appended plates of drawings, in which.

DESCRIPTION OF THE PREFERRED EMBODIMENT

Figure 1:
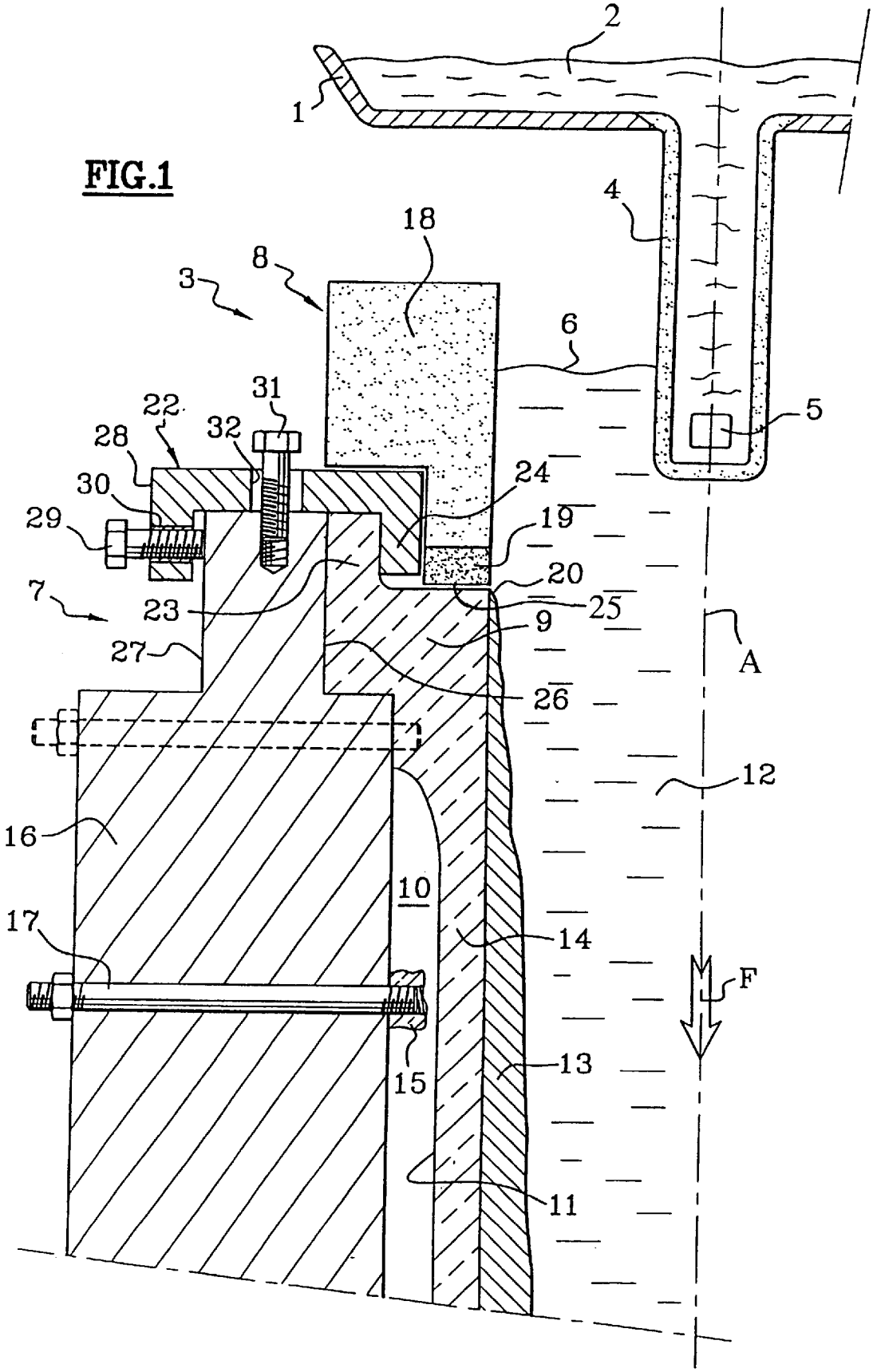
FIG. 1 shows, in vertical section, the upper part of a machine for the continuous casting of slabs which is provided with a mold according to the invention, seen from the side.

Referring to FIG. 1, it may be seen that the top of a machine for the vertical hot-top continuous casting of steel slabs has, in a known manner and in the direction of extraction of the cast metal given by the arrow F placed on the casting axis A (that is to say from the top downwards in the figure), a tundish 1 containing a bath of molten metal 2 which it delivers to a mold 3 (or generally several molds 3) placed some distance below by means of one submerged nozzle 4 per mold and the lateral outlets 5 for the metal of which emerge at about ten cm below the free surface 6 of the liquid metal present in the mold. The mold 3 is schematically composed of two superposed stages 7 and 8 having separate, but complementary, respective functions.

The lower stage 7 constitutes the main part of the mold—the crystallizer—the thermally active element 9 of which has the primary role of giving the cast metal a shape with a mechanical strength of the skin sufficient to prevent downstream breakouts. This element 9—a tube made of copper or more generally a copper alloy—is vigorously cooled by a circulation of water in longitudinal channels 10 (shown in the background in the figure) which are hollowed out in its external face 11, and defines, by its very smooth internal surface, an inner passage 12 for the cast metal.

The upper stage 8 is a feed head made of uncooled refractory material, the inner wall of which is aligned with that of the thermally active element 9 of the crystallizer.

With regard to the casting process, the "cooled metal tube 9 surmounted by the insulating refractory feed head 8" arrangement defines a calibrating passage for the cast metal, the upper portion of which, within the feed head, constitutes a buffer zone for confining the hydrodynamic perturbations caused by the inflow of molten metal into the mold through the outlets 5 of the nozzle 4, and the downwardly extending portion of which is a zone in which the cast metal solidifies.

This solidification, as may be seen, is initiated as soon as the cast steel first comes into contact with the cold metal wall of the crystallizer 7, namely just at the upper edge of the copper element 9, and continues downstream, forming a solid shell 13 whose thickness gradually increases from the periphery toward the center as the cast product descends into the mold. On leaving the mold, the shell 13, having a thickness of one to two centimeters, is strong enough to withstand the ferrostatic pressure of the still liquid core. It then continues its centripetal growth until complete solidification of the cast product due to the effect of water spray rails, not shown, located in the bottom half of the machine. Once the product obtained has completely solidified, it is cut into sections of the desired length (slabs) and these slabs are then available for subsequent forming operations (rolling, etc.).

In the case of the continuous casting of slabs exemplified here, the tubular element 9 conventionally consists of four plates (or walls) joined together at right angles: two large plates facing each other (only one, 14, of which is shown in the figure) and two small end plates, not visible in the figure, which are intended to laterally seal off the casting space 12. These copper plates have a useful thickness of the order of one centimeter so as to make it possible to extract from the cast metal the high heat flux necessary for the solidification process. However, this thickness is insufficient to provide, in complete safety, the required mechanical strength, faced with the ferrostatic pressure and the many stresses and forces to which the assembled element 9 is subjected. Each large plate 14 is therefore coupled to a thick steel backplate 16 to which it is rigidly fastened. Conventionally, this fastening is done by transverse ties 17, the free end of which is screwed into inserts 15 set into countersinks provided for this purpose in the longitudinal ribs of the large plates 14 defining the water circulation channels 10.

As may be seen, the refractory feed head 8 is also formed by two superposed separate elements:

an upper bush 18 made of a low-density refractory material, chosen for its thermal insulation properties since its function is to keep the mass of cast metal present in the feed head in the liquid state. A fibrous refractory, for example the material sold under the name A 120 K by Kapyrok, will be chosen. If required, a resistance heating element may be incorporated;

and a lower element 19, called an "insert", made of hard refractory material, chosen for its good mechanical integrity, and therefore a dense material. Its purpose is in fact to better withstand, at this point close to the crystallizer 7, the mechanical erosion by the upper tip of the solid shell 13 along the copper edge 20, while the whole assembly is subjected to the usual vertical oscillation movement needed for the success of the casting operation, as well as to the thermomechanical stresses of a machine operating in thermal cycles imposed by the necessarily sequential nature of the casting process itself. A material such as SiAlON (Sialon (R)), advantageously doped with boron nitride, is perfectly suitable.

Offset against this increased mechanical strength is the fact that this lower insert 19 is inevitably less heat-insulating than the upper bush 18. There is therefore a risk of the possible formation, in contact with its lower wall aligned with that of the copper element 9, a film of undesirable premature solidification of the cast metal. This is why it is advantageous, according to one implementation of the hot-top casting already known elsewhere (EP-A 0620062), to inject a gas into the base of the feed head 8 for the purpose of breaking the film of undesirable solidification possibly formed above the insert 19 and of then allowing a regular and clear-cut start of the solidification of the metal in contact with the copper element 9.

Having given these reminders about the prior art, the means specific to the invention will now be described in greater detail.

Referring again to FIG. 1, it may be seen that the transverse ties 17 normally located in the upper part of the back plate 16 have been replaced in their fastening function by a clamp 22. This clamp goes over the top of the back plate 16 and the matched large copper face 9, the shape of which has been modified at this point in order for it to be easily engaged in the jaw of the clamp. The shape modification with regard to the copper plate 9 consists, as may be seen, of a dislocation of the upper part so as to produce a shoulder 23 set back with respect to the plane of the copper plate 9 in order, on the one hand, to provide engagement in the passive jaw 24 of the clamp 22 and, on the other hand, to provide a base 25 on which the refractory feed head 8 rests. With regard to the back plate 16, the shape modification is more commonplace: on the "hot" side (toward the inside of the mold), it has a countersink 26 which interacts with the shoulder 23 of the copper plate 9 and, on the other side, it has a thinning cut-back 27 in order to be able to engage in the clamp 22 by providing the active jaw 28 with a bearing surface.

As may be seen, this jaw 28 is called the active jaw since it is provided with easily accessible clamping means located on the "cold" side of the mold and consisting, in the example in question, of a screw 29 engaged in a threaded bush 30 passing through the jaw 28, the free end of the screw bearing against the back plate 16 in order to provide, with the passive jaw 24, the desired vice effect on the back plate/copper plate assembly located in the gap between the jaws 24 and 28 of the clamp 22.

A screw 31 for fitting the clamp 22 to the back plate 16 and for removing it therefrom, is provided on the top, interacting with an oblong through-slot 32 in order to allow the necessary movement play when clamping the side screw 29.

According to an essential characteristic of the invention, the clamp 22 exerts its clamping action, not locally, but over the entire length of each large plate of the mold, or at least over a substantial portion of the latter. The clamping function must in fact be exerted in a sufficiently distributed manner so that the problems of local "hot" deformations of the wall of the mold, which are encountered in the conventional technology, are eliminated. For this purpose, the clamp 22 is an elongate piece, the jaws 24 and 28 of which are in continuous engagement over the entire length, the active jaw 28 being provided with a set of clamping screws 29 distributed over this length. Thus, it is possible to have three or four clamps juxtaposed one after another along the width of the large face of the mold, or even a single clamp which extends over the same distance.

This construction furthermore provides a housing for accommodating the refractory feed head 8. The bottom part of the feed head 8 is then cut in the form of an "L" of shape corresponding to the passive jaw 24 in order to be able, when placing it on the clamp, to be automatically set into the desired position, well aligned with the copper wall 9. This advantage is repeated at the hard refractory insert 19 at the base of the feed head. This insert 19, advantageously made of SiAlON, is not a single piece over the entire width of the large plates 14 but is made from juxtaposed elements kept mutually contiguous by clamping. Thus, a SiAlON bar of the desired length is produced which is much less costly and is much stronger than an equivalent monolithic bar which is commercially available.

Figure 2A:
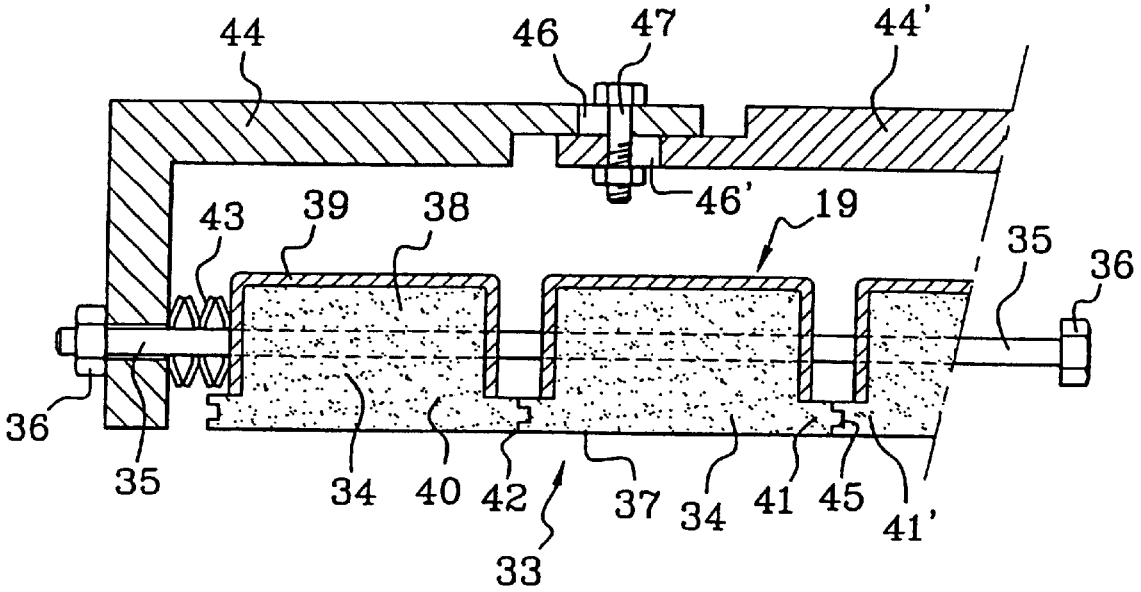
FIG. 2 show the hard refractory insert placed at the base of the feed head and consisting of contiguous assembled sections, seen from above (FIG. 2*a*) and seen from the front face (FIG. 2*b*).
Figure 2B:
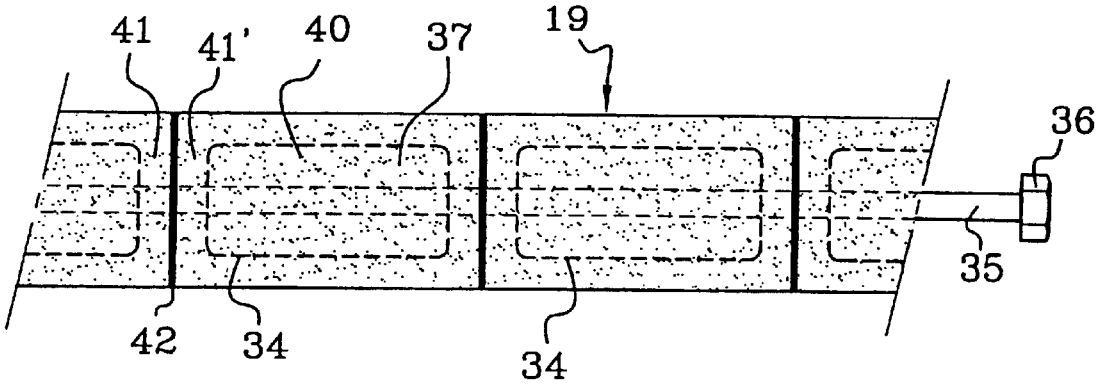

A clamping means built into the insert can be seen in FIGS. 2*a* and 2*b*. In these figures, only one bar 33 is shown in a partial view, said bar constituting the insert as it appears on each of the large faces of the mold. Of course, the insert 19 goes around the inner periphery of the mold. Once it is mounted, it is therefore in the form of a rectangular frame whose large and small sides are formed by straight bars 33 shaped as shown here, each of length equal to the width of the wall of the mold which houses it. As may be seen, the bar 33 consists of an assembly of juxtaposed contiguous links 34 held rigidly clamped together by a clamping means, preferably built into the bar itself. In the example described, this clamping means is a cramp composed of a reinforcing framework having two sliding arms 44, 44' associated with a tie 35 passing right through each link. This tie has lock nuts 36 screwed onto its ends so as, by means of the corresponding arm 44 of the framework, to compress a stack of Belleville washers 43 bearing on the free lateral faces of the two end links 34. In order to allow the framework for supporting each bar 33 to be dimensionally adjusted, the two arms 44, 44' of the framework slide over each other in its central zone via two bearing surfaces 46, 46' provided with oblong slots for the passage of a lock screw 47 which is fastened once the links 34 have been clamped by the nuts 36.

Preferably, the tie 35 is in a position offset toward the "cold" rear face of the bar 33 so as to be remote from its "hot" face 37 intended to come into contact with the molten metal, and therefore thermally more stressed.

Such a clamping means is called an "overall action" clamping means. Like a vice, it mechanically compresses all the links 34 by acting only on those located at the end of the bar. Of course, provision may be made for each link to be individually prestressed with the aid of the tie 35. To do this, all that is required is to have a tie threaded over its entire length and to add intermediate nuts at the junction between two consecutive links.

According to one particular arrangement of the invention, each link 34 has in fact two refractory portions: a "hot" crimped body 38 in a steel box 39 and a head 40 which opens out on the "hot" 37 face side of the insert by extending on either side of the box 39. The lateral projections 41, 41' are carefully smoothed off in order to be able to be intimately applied against one another, from one link 34 to the next, and not to present joints 42 which are too wide and into which the cast molten metal would infiltrate. Moreover, it is advantageous, as shown in FIG. 2*a,* to shape the contiguous front faces of the links 34 in the form of a "mortise and tenon" 45 in order to facilitate their interlocking and, consequently, their mutual alignment and the sealing of the junction zones against possible infiltrations of liquid metal.

It goes without saying that the invention is not limited to the example described but extends to many variants or equivalents provided that its essential characteristics given in the appended claims are reproduced.

Moreover, it should be noted that although the invention has been initially given specifically in the case of the casting of slabs and other products of elongate shape, it remains no less applicable to the casting of products of any shape provided, of course, such products can be cast using the technique of hot-top continuous casting.

Likewise, the invention applies to the continuous casting not only of steel but of any other continuously castable metal and especially metals having a lower melting point than steel, such as aluminum or copper.

What is claimed is:

1. A mold of wide cross section for the hot-top vertical continuous casting of metals, comprising:

a metal tubular element cooled by the circulation of a coolant, said tubular element being formed by a plurality of metal plates defining a internal passage for a cast metal;

a feed head made of a thermally insulating refractory material, said feed head surmounting and being internally aligned with said tubular element;

a reinforcing backplate rigidly fastened to at least one of said plates of said tubular element;

a clamp including a plurality of jaws, wherein an upper part of said at least one of said plates has a shoulder set back with respect to the internal passage for the cast metal so as to be able to engage with one of the jaws of the clamp, said jaws of said clamp clamping together said shoulder of said at least one of said plates and said reinforcing backplate; and means for adjusting the clamping together of said shoulder of said at least one of said plates and said backplate being provided on said clamp, wherein said shoulder provides a space which is occupied by the feed head.

2. The continuous casting mold as claimed in claim 1, wherein a lower portion of the feed head is shaped in the form of an "L" so as to surmount a top portion of the clamp.

3. The continuous casting mold as claimed in claim 1, wherein a base of the feed head comprises a ring which is made of a hard and smooth refractory material and which includes a straight bar formed by a contiguous assembly of elementary links which are aligned one after the other and held clamped together.

4. The continuous casting mold as claimed in claim 3, wherein each of said elementary links includes a projection extending beyond the limits of a reinforcing box housing said elementary link.

5. The continuous casting mold as claimed in claim 1, wherein said means for adjusting the clamping adjusts a first jaw of said plurality of jaws of the clamp which contacts the reinforcing backplate.

6. The continuous casting mold as claimed in claim 1, further comprising at least one transverse tie for fastening said reinforcing backplate to said at least one of said plates of said tubular element.

* * * * *